United States Patent [19]

Garner

[11] Patent Number: 4,712,368

[45] Date of Patent: Dec. 15, 1987

[54] MANUFACTURE OF TELECOMMUNICATIONS CABLE CORE UNITS

[75] Inventor: John N. Garner, Kingston, Canada

[73] Assignee: Northern Telecom Limited, Montreal, Canada

[21] Appl. No.: 31,295

[22] Filed: Mar. 30, 1987

[51] Int. Cl.[4] ..... H01B 13/04

[52] U.S. Cl. ..... 57/314; 57/6; 57/59; 57/66; 57/293; 174/34

[58] Field of Search ..... 57/6, 12–15, 57/59, 60, 66, 311, 293, 294, 314; 174/34

[56] References Cited

U.S. PATENT DOCUMENTS

| | | | |
|---|---|---|---|
| 2,412,196 | 12/1946 | Ashbaugh et al. | 57/314 X |
| 2,530,726 | 11/1950 | Rasmussen | 57/314 X |
| 2,572,052 | 10/1951 | Pheazey | 57/293 X |
| 3,001,353 | 9/1961 | Lapsley | 57/60 X |
| 3,369,355 | 2/1968 | Burr | 57/314 |
| 4,459,799 | 7/1984 | Beucher | 57/293 |
| 4,554,782 | 11/1985 | Garner | 57/66 |
| 4,559,771 | 12/1985 | Garner et al. | 57/6 |
| 4,566,264 | 1/1986 | Garner | 57/314 |
| 4,577,403 | 3/1986 | Garner | 57/314 X |
| 4,581,885 | 4/1986 | Garner | 57/314 |

*Primary Examiner*—John Petrakes
*Attorney, Agent, or Firm*—R. J. Austin

[57] ABSTRACT

Apparatus for changing relative positions of conductor pairs in a cable core in which each pair is moved through its individual guide movable around a substantially circular path. The guides lie in series and move independently of one another. An array forming device at the downstream end of the movable guides has a smooth convex surface for engaging the conductors and holds them in an array while enabling the pairs to change their relative positions in the array as dictated by movement of the guides. A closing die for the conductor pairs is located downstream from the array forming device.

12 Claims, 10 Drawing Figures

MANUFACTURE OF TELECOMMUNICATIONS CABLE CORE UNITS

This invention relates to the manufacture of telecommunications cable core units.

A telecommunications cable is constructed with a core comprising one or more core units, each having a multiplicity of twisted units of conductors, each conductor unit conventionally being a twisted pair of conductors. A core may be formed as a single core unit of twisted conductor units, e.g. 25 or 50 pairs. A larger core, i.e. up to 3600 twisted pairs, comprises a plurality of core units. The twisted pairs are stranded together in a stranding machine to form a core unit with the conductors of each pair twisted with a predetermined lead to the twist, i.e. the distance taken along the pair for each conductor to complete a single revolution along its path. This distance will be referred to in this specification as the "twist lay" of a pair. There are different twist lays provided for the twisted pairs in a core unit with a pair having a particular twist lay being adjacent to other pairs of different twist lays. Care is taken, so far as is practicable, to ensure that pairs of equal or similar twist lays are separated from each other. The reason for this arrangement is to attempt to maximize the communications performance of the cable, e.g. to lessen pair-to-pair capacitance unbalance, to reduce crosstalk between pairs and to lower the coefficient of deviation of mutual capacitance of pairs in the cable.

In a conventional core unit, however, twisted conductor pairs retain their positions relative to other pairs, within certain limits. It is recognized that the pair-to-pair capacitance unbalance and crosstalk between any two pairs is dependent to a large degree upon the distance of the two pairs from one another. To reduce the pair-to-pair capacitance unbalance and to improve crosstalk, suggestions have been made to take positive steps to change distances apart and relative positions of conductor pairs within a core unit. These steps involve the moving of conductor pairs relative to one another as they progress towards a stranding machine. In a suggested method for changing the relative positions of conductor pairs as they move towards the stranding machine, the conductor pairs enter a guide arrangement which comprises a system of horizontal guides movable horizontally and located in vertically tiered fashion. The pairs are distributed throughout the tiers and relative horizontal movement of the guides changes the relative positions of the pairs as they move downstream. This method was first suggested by Sigurd Norblad of Telefonaktiebolaget L.M. Ericsson in a paper entitled "Multi-Paired Cable of Non-Layer Design for Low Capacitance Unbalance Telecommunication Networks" read before the International Wire and Cable Symposium in 1971. In this method, the conductor pairs need to be controllably arranged together in their changing relative positions preparatory to their passage into a closing die, in which they are drawn together to form the core unit. Controllable arrangement of the pairs should be possible by passing them from their various positions partly around rollers. However, extreme height of the Ericsson machine, even for changing positions of twenty-five pairs, is such that severe change in angles of feedpaths of some of the conductor pairs is required for them to pass around the rollers. Such a severe change can cause damage to either the conductors or to their insulation, particularly if the insulation is made from pulp, and will also induce large tension variations between conductor pairs.

Other suggestions have been put forward by the present inventor for changing the relative positions of the conductor pairs. These various suggestions are disclosed in U.S. Pat. Nos. 4,554,782, granted Nov. 26, 1985; 4,559,771, granted Dec. 24, 1985; 4,566,264, granted Jan. 28, 1986 and 4,581,885, granted Apr. 15, 1986. All of these patents are entitled "Manufacture of Telecommunications Cable Core Units".

While it is possible to relatively move conductor pairs laterally with apparatus disclosed in each of the above four patents, such apparatus may be unduly expensive and subject to complex design considerations and, furthermore, cannot controllably ensure that certain conductor pairs do not lie side-by-side for lengthy distances in a core unit thereby reducing the electrical advantages desired.

The present invention provides an apparatus for controllably positioning conductor units in a cable core unit thereby minimizing the possibility of two adjacent conductor units lying side-by-side for any substantial distance along the core unit. The apparatus of the present invention may also be used to prevent conductor units from following similar or parallel paths which, even though not closely adjacent, could have some disadvantageous crosstalk or electrical effects. The invention also provides a cable core unit which may be constructed upon the apparatus of the invention and has certain advantageous constructional characteristics.

The invention provides according to one aspect, an apparatus for forming a core unit from telecommunications conductor units in which each conductor unit is formed of twisted together insulated conductors, the apparatus comprising a plurality of arcuate position changing means for conductor units, each position changing means for moving an individual conductor unit laterally as it is moved along an individual passline, the position changing means located in spaced side-by-side relationship in series in the general direction of passlines for conductors and so as to extend around a volumetric space; each position changing means comprising a movable conductor unit guide, a guide mounting means providing an arcuate path for movement of the movable guide into four quadrants around the volumetric space, and driving means drivably connected to the movable guide to move the guide alternately in one direction and then in the other around the arcuate path and into all four quadrants around the volumetric space; fixed guide means disposed upstream of the plurality of position changing means, the fixed guide means defining an individual fixed guide surface for each conductor unit and cooperating with an associated movable guide to control movement of the conductor unit along its feedpath through the volumetric space and through a gap between position changing means for any position of the movable guide on its arcuate path, the fixed guide surfaces relatively disposed to avoid twisting together of conductor units in the volumetric space during movement of the movable guides along the arcuate paths; an array forming means having a smooth convex conductor engaging surface extending transversely of the general direction of the passlines and in line with and downstream of the series of position changing means for holding the conductor units in an arcuate array while enabling relative positional change of the units around the array as the movable guides move independently on their arcuate paths; and a core unit forming and take-up means to draw the conductor units together to form the core unit.

In a particularly practical and preferred construction, each guide mounting means defines an arcuate path lying on the arc of a circle, the arc lying also in a plane transverse to the associated feedpath. However, the guide mounting means may define arcuate paths other than circular, for instance ellipsoidal paths.

It is also preferred for the guide mounting means and their arcuate paths to have diameters which are substantially equal from one position changing means to another.

With each fixed guide surface being for an individual conductor unit, then in use of the preferred apparatus, each of the conductor units moves laterally by virtue of movement of the movable guides, around a path which lies on the surface of a cone with each movable guide moving around the periphery of the base of the cone and the fixed guide surface disposed at the cone apex. In a practical arrangement, with the fixed guide surfaces disposed along a line inclined relative to the general direction of the feedpaths and succeeding one another in the same downstream order as their associated movable guides, the conductor units move around paths lying on the surfaces of respective cones which are telescoped within one another and are contained at least partly within the volumetric space but, in any case, do not extend radially outside it.

It can thus be seen that the plurality of position changing means may occupy a small space both axially and radially and in practice the radial direction of the changing means need not be substantially greater than the finished diameter of the core unit.

As stated above, the guide surfaces lie along a line which is inclined relative to the general direction of the feedpaths with the guide surfaces succeeding one another downstream in the same downstream order as their associated movable guides. By the positioning of the guide surfaces in this way, a simple construction is provided which ensures that the conductor units do not become entangled as they move towards the position changing means.

The invention also provides a core unit for a telecommunications cable comprising a plurality of conductor units each formed from twisted together insulated conductors and in which each conductor unit extends along the core unit while moving angularly around the longitudinal axis of the core unit in reversing manner for an angle of above 270° and approaching 360° and wherein each conductor unit is randomly disposed over any given core unit length in relation to any other conductor unit.

Embodiments of the invention will now be described, by way of example, with reference to the accompanying drawings, in which.

Figure 2:
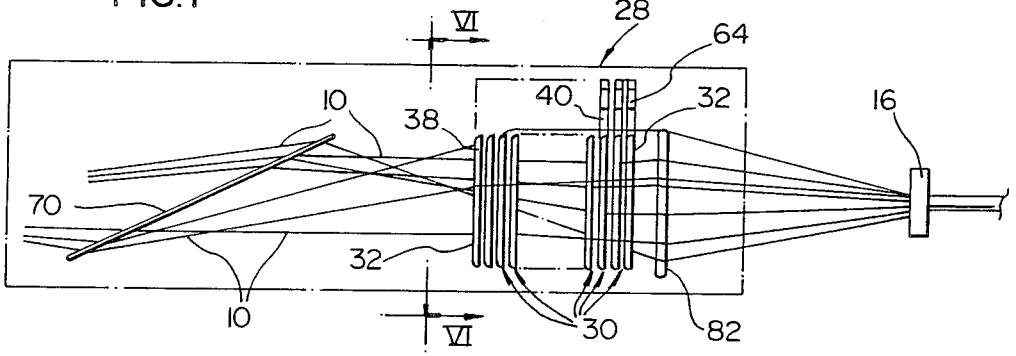
FIG. 2 is a view similar to FIG. 1 of a position changing means of the apparatus of FIG. 1 and to a larger scale.
Figure 3:
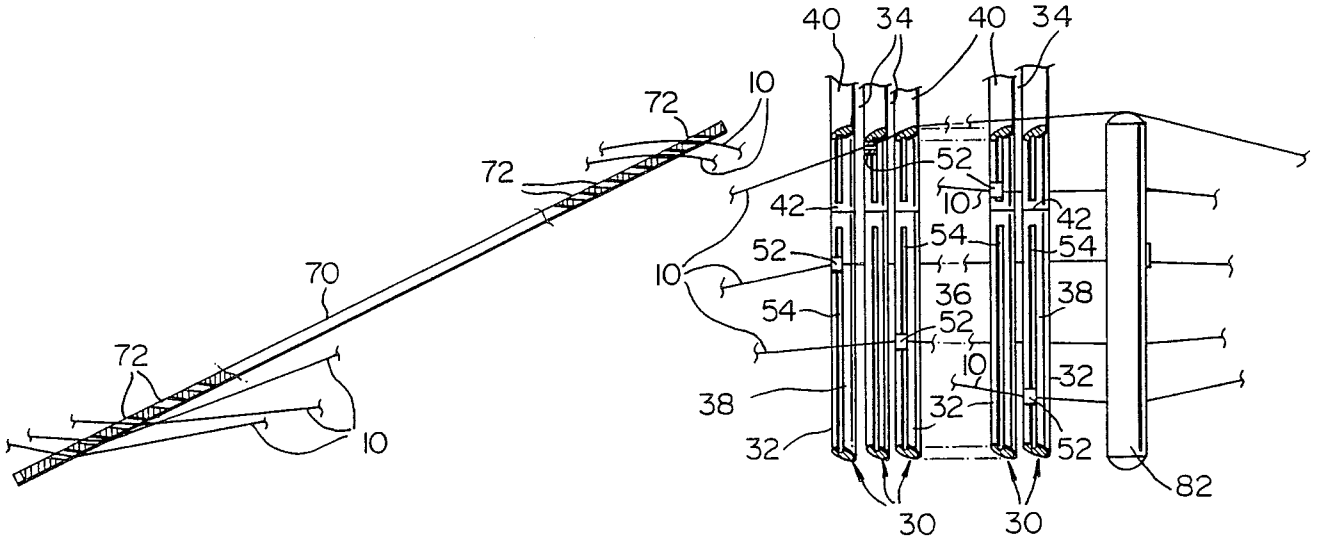
Figure 4:
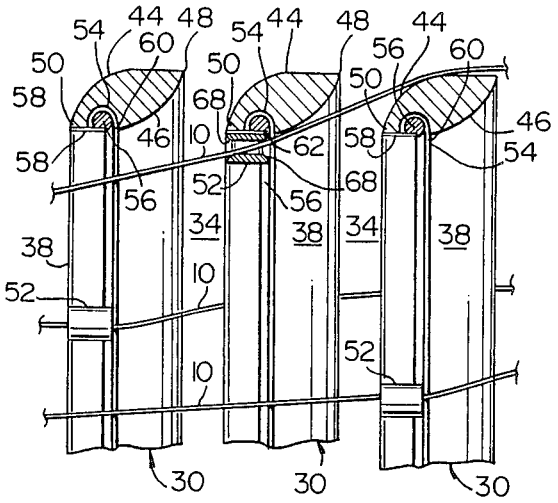
Figure 5:
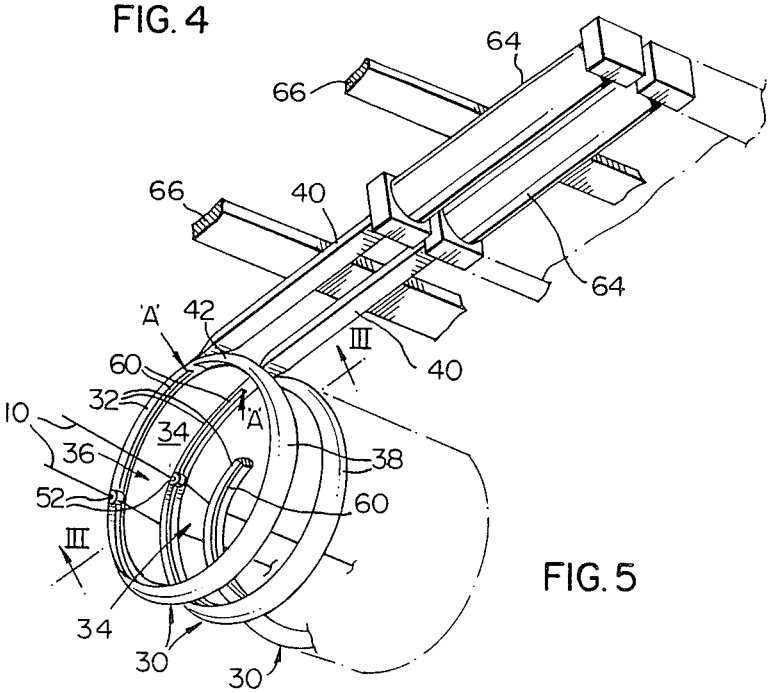
Figure 6:
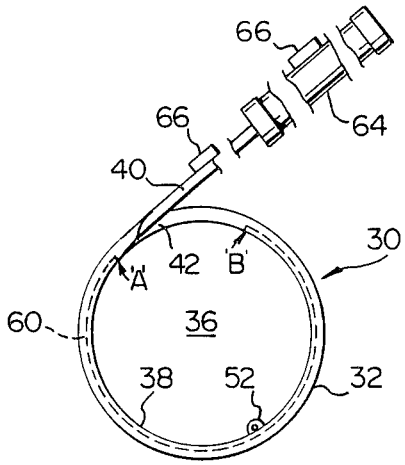
Figure 7:
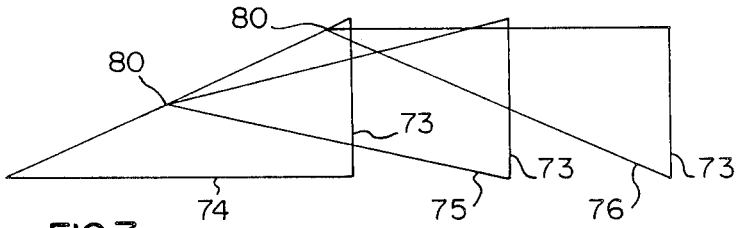
Figure 8:
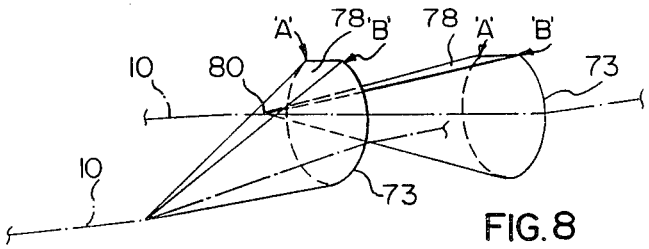
Figure 9:
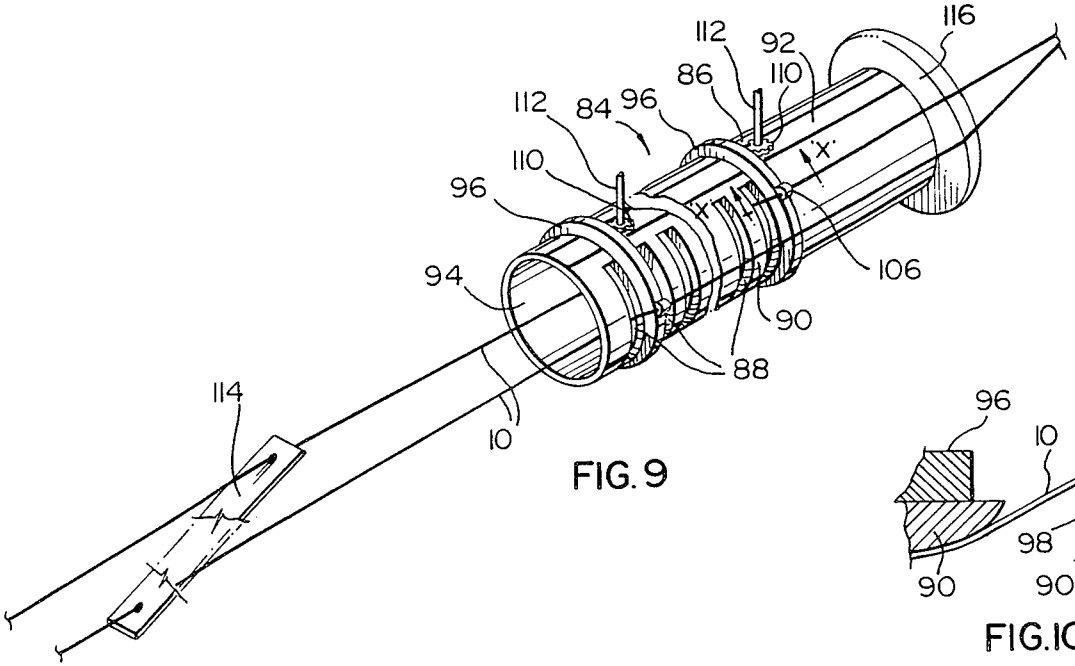
Figure 10:
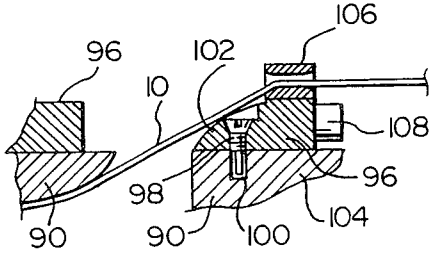

FIG. 3, to a larger scale than FIG. 2, is a side elevational view in cross-section along line III—III in FIG. 5 to show more detail of the position changing means;

FIG. 4 is a cross-sectional view in the same direction as FIG. 3 of the position changing means to greatly enlarged scale to show detail;

FIG. 5 is an isometric view of part of the position changing means viewed from beneath;

FIG. 6 is a cross-sectional view of the apparatus taken along line VI—VI in FIG. 2;

FIG. 7 is a diagrammatic view in the same direction as FIG. 2 and showing the paths of different conductor pairs as they pass through position changing means of the apparatus;

FIG. 8 is an isometric diagrammatic view showing the paths of FIG. 7;

FIG. 9 is an isometric view of a position changing means of an apparatus according to a second embodiment; and FIG. 10 is a section of the apparatus of the second embodiment, taken along line X—X in FIG. 9 and to a larger scale.

Figure 1:
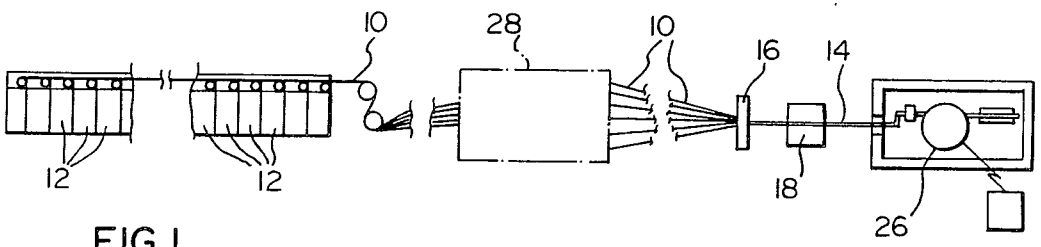
FIG. 1 is a side elevational view of an apparatus according to a first embodiment for forming a core unit from conductor pairs.

In a first embodiment as shown in FIG. 1, twenty-five conductor pairs 10, each formed from two twisted together individually insulated conductors, are drawn in conventional fashion, from twenty-five reels 12 of the conductor pairs, for forming into a core unit 14. The core unit 14 is formed at the downstream end of the apparatus by passing the conductor pairs through a closing die 16 which draws the conductor pairs together, and a binding head 18 at which position a binding material is closed around the drawn together conductor pairs to hold them together in conventional manner. Downstream from the binding head 18 is a conventional motor driven core unit take-up reel 26.

Upstream from the closing die 16 is a device 28 for changing the relative positions of conductor pairs.

As shown in FIGS. 2 to 6, the device 28 comprises a plurality of position changing means 30. Each position changing means is for moving an individual conductor unit pair 10 laterally as it is moved along an individual passline from a reel 12 to the closing die 16.

The position changing means comprise a plurality of elongate rigid members 32, one for each changing means, the members 32 disposed side-by-side in series in the general direction of the passlines of the conductor pairs. As shown in FIGS. 2, 3, 4 and 5, the members 32 are spaced slightly to provide gaps 34 between them, for reasons to be described, and together surround a volumetric space 36. The gaps 34 in FIG. 5 are shown with increased width for reasons of clarity.

Each rigid member 32 comprises an arcuate portion 38 which lies on the arc of a circle and a rectilinear portion 40 which extends from one end of the arcuate portion at a tangent to the arc. The other end 42 of the arcuate portion is secured to a part of the member at or adjacent the junction of the arcuate portion with the rectilinear portion, thereby providing a closed loop. The rigid members 32 may be formed from structurally rigid material such as steel or aluminum. In any case, the rigid members must have smooth surfaces in areas which may be contacted by a travelling conductor pair. To provide such a smooth surface and make it hard and wear resistant, each member 32 is formed from steel which is hardened or is ceramic coated or has an anodized polymer impregnated surface.

As may be seen particularly from FIGS. 3 and 4, each rigid member is formed with two convex surfaces 44 and 46 which converge at two axially opposite positions. These convex surfaces are provided to assist in the passage of conductor pairs through the gaps 34 and, to this end, the downstream position 48 of convergence of each member is radially outside the upstream position 50 of convergence of the next adjacent downstream member. Each gap 34 is thus inclined generally in a radially outward and axially downstream direction although the arcuate portions 38 of the members 32 lie at substantially equal diameters and are axially aligned.

Each rigid member 32 forms a guide mounting means for a movable conductor unit guide 52 which is a short cylinder. As shown in FIGS. 3, 4 and 5, each movable guide 52 is located radially inwardly of a guide channel 54 formed along the length of the associated rigid member. Driving means is provided for moving the movable guide around the inside of the arcuate portion 38 of each rigid member. For each position changing means, the driving means comprises a flexible member in the form of a cable 56 (FIG. 4) which is slidably received within its guide channel 54. Each metal strip is held in position in its channel by a retaining plate 58 secured to an upstream side of the surface 46. The retaining plate 58 is formed of a suitable material such as spring steel which may easily be flexed into the shape required and secured into position. A radial opening 60 to the channel is provided between an edge of the plate 58 and the opposite edge of the channel. Through this opening extends a rigid neck 62 which secures one end of the cable 56 to the movable guide 52. The other end of cable 56 is joined to a piston rod which extends from an air cylinder 64 (see particularly FIG. 5). As shown by FIG. 5, each position changing means is secured to a frame 66 which extends along side the changing means in a position away from passlines for conductor pairs, the rectilinear portions 40 of the rigid members and cylinders 64 attached to the frame. The air cylinder provides a primary moving member of the driving means and moves the cable 56 along channel 54 to move the guide 52 along an arcuate path around the inside of the rigid member 32. Each movable guide 52 is movable alternately, in one direction and then in the other, into all four quadrants of the arcuate portion 38 of its rigid member 32. Thus each movable guide moves around the arc of a circle transversely to the general feedpath of conductor pairs and angularly for more than 270° around the center of curvature of the arcuate path. In this embodiment, the angle is actually about 310° with regard to the center of radius of each of the arcuate portions 38.

The angle of movement of each movable guide is dictated by the stroke of the piston in the cylinder, but in any case cannot extend beyond the limits of the arc length of radial opening 60 to the guide channel 54. As shown particularly by FIG. 6, the rigid members are disposed with cylinders 64 inclined. In these positions, the radial openings 60 extend around the arcuate portions 38 between positions 'A' and 'B'. Compare FIGS. 5 and 6 particularly. Thus the movable guides cannot move upwardly beyond these two positions.

Each of the movable guides 52 is a short cylinder (FIG. 4) of smooth and hard wearing surface material, such as steel with an anodized polymer impregnated surface or ceramic coat, or possibly tool steel. At each end of each guide 52, the inner bore blends smoothly with the ends of the cylinder with a small radius 68 to eliminate any sharp edges to the cylinder.

The device 28 also comprises guide means disposed upstream of the position changing means to guide conductor pairs 10 into the volumetric space 36 and to feed them into their respective guides 52. This guide means is fixed and is essentially constructed to locate guide surfaces in such relative positions to avoid twisting together of conductor pairs as they pass through the volumetric space 36 and during movement of the guides 52 along their arcuate paths. This guide means comprises a guide bar 70 which, as shown in FIGS. 2 and 3, slopes with regard to the general feedpath for the conductor pairs and also with regard to the plane of each of the arcuate portions 38 of the rigid members 32. As can be seen from FIG. 3 particularly, the guide bar 70 is formed with a plurality of guide apertures 72, these apertures being spaced apart from end-to-end of the guide bar. The apertures succeed each other downstream in the same downstream order as their associated position changing means.

The angle of inclination of the guide bar 70 is such that after conductor pairs have been fed through their respective guide apertures 72 and through their respective guides 52, then movement of the guides 52 along their arcuate paths randomly and out-of-phase with each other, causes no twisting together of the conductor pairs As can be seen from considering FIGS. 7 and 8, each of the guides 52 moves around an arc 73 of approximately 310° around the center of its circular path and between positions 'A' and 'B' (compare FIGS. 5 and 8) so that its conductor pair 10 (shown chain dotted in FIG. 8) sweeps around the surface of an asymmetrical cone (for instance shown at 74, 75 and 76 in FIGS. 7 and 8). The apex of each cone coincides with the outlet or downstream side of the respective apertures 72. If the parts of conical surfaces unswept by conductor pairs are located correctly with regard to the guide bar 70 then all of the conductor pairs will move in an arc which avoids a top central region 78 between positions 'A' and 'B' and which accommodates the apices 80 of all of the conductor pairs downstream from it. In this way, although the conical surfaces of pair movement are telescoped within one another, contact between any conductor pair and a downstream pair is avoided by the simple fact that each upstream pair moves around the surface of a cone which lies completely outside the surfaces of all of the swept cones downstrem from it. Thus a simple method is provided of producing random movement of the conductor pairs around their respective arcs while ensuring that the conductor pairs avoid each other.

Downstream from the assembly of position changing means the device 28 comprises an array forming member 82 (FIGS. 2 and 3) located in a plane transversely of the general direction of the feedpaths for holding the conductor units on their feedpaths in an arcuate array. The array forming member 82 is a toroid which is disposed coaxially with regard to the assembly of position changing means and has an outside diameter which is greater than the outside diameter of each of the arcuate portions 38. The surface of the array forming member 82 is of a hard waring resistant material. As with the rigid members 32, the array forming member may be formed from steel or aluminum which is suitably coated with a ceramic or has an anodized polymer impregnated surface for instance. Downstream from the array forming member 82 is the closing die 16.

In use of the apparatus 10, the individual conductor pairs are fed from their respective reels 12 and each pair is passed through its respective guide passage 72 which guides the pair through the volumetric space 36 and then through its movable guide 52. As can be seen from the figures, each conductor pair then emerges from the downstream end of its guide 52 and passes immediately between its own and the next immediately downstream arcuate portion 38, i.e. through adjacent downstream gap 34, before proceeding axially along the downstream position changing means while being radially disposed outwardly from them. The conductor pairs then pass around and into contact with the outside of the array forming member 82, before moving through the closing die 16. The pairs pass through the binder head 18 to form the core unit 14 which then passes to the take-up reel 26. As the conductor pairs move along their feed-paths towards the closing die 16, each of the air cylinders 64 is individually operated, possibly with computer control to move the cables 56 and thus the movable guides 52, each in a particular individual reciprocating manner and individual speed around the arcuate portions 38. Thus, the movement of each of the movable guides 52 is completely unrelated to the movement of any of the other movable guides with regard to speed or position. Further to this, the speed of any of the movable guides may be changed at any instant as required. With independent movement of the cylinders 64, each conductor pair is caused to sweep around the surface of its asymmetrical cone (e.g. cones 74, 75 and 76 in FIG. 7) as it moves through the volumetric space 36. For reasons already discussed, it is ensured that none of the conductor pairs can interfere with any of the other pairs by virtue of the position of the guide bar 70 in relation to the movable guides 52. Should any of the conductor pairs contact any guide 52 while moving circumferentially past it, then the conductor pair will be immediately deflected slightly away from its path by the contacted guide to enable the conductor pair to continue sweeping along its individual cone surface unhindered. As a result of the movements of the movable guide 52, each of the conductor pairs may be forced to follow a sweeping path of movement for a maximum angle of approximately 310° around the center of radius of the arcuate portion 38 of its respective rigid member 32 and this effectively moves the conductor pairs circumferentially around the array forming member 82 as they proceed towards the closing die 16. This angle may be below 310° for any particular pair as decided by the length of stroke in the associated cylinder under computer control. While it has been found that the movable guides 52 tend to position the conductor pairs generally in a particular circumferential region upon the array forming member 82 at any particular instant, the position of any conductor pair within a specific circumferential arc tends to be rather random. This is because in passing over the forming member 82, the conductor pairs must pass over and contact each other to move around the member 82 as dictated by the speeds and directions of movement of the movable guides 52. This contact between the pairs produces a small degree of drag to their movement around the array forming member thereby influencing their individual and respective positions at any instant. A randomizing influence is therefore placed upon the positions of the conductor pairs although their general positions are dictated by the positions of the movable guides 52.

In consequence, as the conductor pairs pass through the binding head 18 each conductor pair is in a completely randomized position at any instant with regard to other conductor pairs and its movement characteristics are unrelated to those of other pairs. It is also ensured that at least some and preferably all conductor pairs move constantly in reciprocating manner through the four quadrants of the finished core unit as the pairs extend along the core unit.

The combination of the plurality of position changing means, fixed guide means and array forming member in apparatus of the invention may be made particularly small with regard to the important function which it is to perform. For instance, in the first embodiment for making a twentyfive pair core unit, the total length of the device 28 is about 138 cms while the diameter of the arcuate portions 38 of rigid members 32 is approximately 25 cms. The axial distance along the in series position changing means 30 is approximately 60 cms. Although the apparatus is particularly small, it is particularly effective in obtaining the type of randomized movement of the conductor pairs into the four quadrants of a core unit which will provide a construction to minimize the disadvantageous crosstalk and electrical effects which are found with the side-by-side location of conductor pairs in a conventional core unit.

In apparatus of the second embodiment, as shown in FIGS. 9 and 10, the structure which is otherwise as described for the first embodiment has a device 84 for changing the relative positions of conductor pairs in a core unit and which comprises a rigid cylindrical support 86 (FIG. 9). This support is formed with spaced circumferential slots 88 which extend around the support for angles in excess of 300° to provide arcuate ring sections 90 joined together by a remaining axially extending part of the support or backbone 92. The spaced ring sections 90 and the backbone 92 surround a volumetric space 94. Mounted upon the support 86 are a plurality of rings 96, one for each conductor pair, and each of the rings is positioned around an individual ring section 90 upon which it is retained by any acceptable means to allow for rotation of the rings around the support. For clarity, only two of the rings 96 are shown in FIG. 9. As shown in FIG. 10, each ring 96 is held axially upon its ring section 90 in this embodiment by screws 98 received screw-threadedly secured within a hole through the ring, the screws passing into a circumferential groove 100 around the ring section 90 and having inner screw ends shaped for sliding reception within the groove. The rings 96 are formed with convex upstream surfaces 102 and the ring sections 90 with convex downstream surfaces 104 to assist in passage of conductor pairs 10 through the gaps between the ring sections 90 formed by the slots 88. The ring sections 90 and rings 96 are smooth surfaced for hardness and wear resistance and may be of the material and surface finish of the rigid members 32 of the first embodiment. A movable conductor pair guide 106 is securely mounted upon the outer surface of each ring 96, the guide being similar to the structure of the guides 52 in the first embodiment.

Driving means is provided for each movable guide 106. Each driving means comprises a driven gear 108 formed on the downstream side of the associated ring 96 (FIG. 10) and concentric with it, and a driving gear 110 (FIG. 9) in mesh with gear 108 and rotatably mounted upon the backbone 92 of cylindrical support 86. Each gear 110 is drivable by a vertical shaft 112 of the driving means which also includes an individual primary drive for the shaft. This primary drive may be an electrically controlled pneumatic device (not shown) or a quick reversing electric motor (not shown). Reversal of each device and thus of its ring 96 is effected at the end of ring rotation in each direction by a rotation position device. Such devices, as are well known in engineering fields, include an inductance measuring device operable by a trigger element mounted upon the ring 96 or by a reed switch. As such devices are well known, further detail is deemed unnecessary.

The device 84 also has a fixed guide bar 114 and an array forming member 116 of similar structure to guide bar 70 and member 82 of the first embodiment.

In operation of the apparatus of the second embodiment, the conductor pairs extend through individual guide passages in guide bar 114, through volumetric space 94 and then each pair passes through an individual gap created by the slot 88 formed immediately upstream from the movable guide 106 through which the pair 10 passes. Each pair continues along its passline from its movable guide 106 and around the array forming member then to proceed through the closing die and binding head to the take-up reel as described in the first embodiment.

The rings 96 are rotated by the stepper motors 110, alternately in one direction and then in the other to render the guides 106 movable around the axis of cylindrical support 86. During this movement each of the conductor pairs 10 while passing through its respective gap formed by a slot 88 is also caused to move around the slot in a circumferential direction.

By rotating the rings 96 possibly at different speeds and changing their rotational direction nonsynchronously, the conductor pair positions and lateral movement as they pass over the array forming member 116 are completely unrelated to one another from one pair to another while each pair is desirably caused to move into each quadrant of the finished cable.

What is claimed is:

1. Apparatus for forming a core unit from telecommunications conductor units in which each conductor unit is formed of twisted together insulated conductors, the apparatus comprising:

a plurality of arcuate position changing means for conductor units, each position changing means for moving an individual conductor unit laterally as it is moved along an individual passline, the position changing means located in spaced side-by-side relationship in series in the general direction of passlines for conductors to extend around a volumetric space;

each position changing means comprising a movable conductor unit guide, a guide mounting means providing an arcuate path for movement of the movable guide into four quadrants around the volumetric space, and driving means drivably connected to the movable guide to move the guide alternately in one direction and then in the other around the arcuate path and into all four quadrants around the volumetric space;

fixed guide means disposed upstream of the plurality of position changing means, the fixed guide means defining an individual fixed guide surface for each conductor unit and cooperating with an associated movable guide to control movement of the conductor unit along its feedpath through the volumetric space and through a gap between position changing means for any position of the movable guide on its arcuate path, the fixed guide surfaces relatively disposed to avoid twisting together of conductor units in the volumetric space during movement of the movable guides along the arcuate paths;

an array forming means having a smooth convex conductor engaging surface extending transversely of the general direction of the passlines and in line with and downstream of the series of position changing means for holding the conductor units in an arcuate array while enabling relative positional change of the units around the array as the movable guides move individually on their arcuate paths; and a core unit forming and take-up means to draw the conductor units together to form the core unit.

2. Apparatus according to claim 1 wherein the guide mounting means define arcuate paths for the movable guides lying on the arcs of circles.

3. Apparatus according to claim 2 wherein the arcuate paths of the guide mounting means lie at substantially equal diameters from one position changing means to another.

4. Apparatus according to claim 2 wherein the arcuate paths of the guide mounting means decrease in diameter from one position changing means to another in the downstream direction.

5. Apparatus according to claim 2 wherein each guide mounting means is formed with a guide channel, the guide channel extending around the arc of a circle and having a radial opening, and the guide moving means comprises a primary moving member and a flexible member longitudinally movably received within the guide channel and drivable along the channel by the primary member, the flexible member carrying the associated movable guide which projects through the radial opening beyond the guide channel.

6. Apparatus according to claim 5 wherein each guide channel has one end portion extending outwardly from the circular path and the primary moving member is drivably connected to the flexible member at said one end portion of the channel.

7. Apparatus according to claim 6 wherein the position changing means are secured to a support frame at positions of the changing means which are spaced from parts of the guide channels extending around the arc of the circle and the part of each channel on the arc of the circle extends in a substantially closed loop to maximize the angular extent of the channel around the center of the circular path.

8. Apparatus according to claim 7 wherein the primary moving means comprises a fluid operated cylinder.

9. Apparatus according to claim 5 wherein in each position changing means, the movable guide extends radially outwardly from its guide channel so that the passline for a conductor unit extends from the associated guide surface, through an arcuate gap between said position changing means and the next adjacent upstream changing means, through said movable guide and then across the convex surface of the array forming member to the core unit forming and take-up means.

10. Apparatus according to claim 5 wherein in each position changing means, the movable guide extends radially inwardly from its guide channel so that the passline for a conductor unit extends from the associated guide surface, through said movable guide, through an arcuate gap between said position changing means and the next adjacent downstream changing means, and then across the convex surface of the array forming member to the core unit forming and take-up means.

11. Apparatus according to claim 2 comprising a cylindrical support for the plurality of position changing means, the support formed with a plurality of circumferential slots to provide axially spaced ring sections joined together by an unslotted part of the support, and each position changing means has a guide mounting means comprising a ring which is rotationally mounted upon an individual ring section, the ring securely holding a respective movable guide.

12. Apparatus according to claim 11 wherein the rings are rotatably mounted around their ring sections and the movable guides extend radially outwardly from their rings.

* * * * *